US006079505A

United States Patent [19]

Pignard et al.

[11] Patent Number: 6,079,505

[45] Date of Patent: Jun. 27, 2000

[54] SYSTEM AND METHOD FOR THE ACQUISITION OF PHYSICAL DATA LINKED TO A DRILLING OPERATION IN PROGRESS

[75] Inventors: Guy Pignard, Rueil Malmaison; Claude Mabile, Clamart, both of France

[73] Assignee: Institut Francais du Petrole, Rueil, France

[21] Appl. No.: 08/427,972

[22] Filed: Apr. 21, 1995

Related U.S. Application Data

[63] Continuation of application No. 08/022,895, Feb. 26, 1993.

[30] Foreign Application Priority Data

Feb. 27, 1992 [FR] France ..... 92 02273

[51] Int. Cl.[7] ..... E21B 47/00

[52] U.S. Cl. ..... 175/40; 175/45; 166/66

[58] Field of Search ..... 166/66; 175/40, 175/45; 367/82, 83, 84, 85; 439/194

[56] References Cited

U.S. PATENT DOCUMENTS

| | | | |
|---|---|---|---|
| 4,027,282 | 5/1977 | Jetter | 367/85 |
| 4,126,848 | 11/1978 | Denison . | |
| 4,216,536 | 8/1980 | Moie | 367/83 |
| 4,298,970 | 11/1981 | Shawhan et al. | 367/82 |
| 4,320,473 | 3/1982 | Smither et al. | 367/82 |
| 4,468,665 | 8/1984 | Thawley et al. | 367/76 X |
| 4,472,884 | 9/1984 | Engebretson | 33/304 |
| 4,562,559 | 12/1985 | Sharp et al. | 175/40 X |
| 4,578,675 | 3/1986 | MacLeod | 340/854.6 X |
| 4,684,946 | 8/1987 | Issenmann | 340/854.6 X |
| 4,715,451 | 12/1987 | Bseisu et al. . | |
| 4,775,009 | 10/1988 | Wittrisch et al. | 166/66 X |
| 4,806,115 | 2/1989 | Chevalier et al. | 439/194 |
| 5,181,565 | 1/1993 | Czernichow | 166/66 |
| 5,237,540 | 8/1993 | Malone | 367/84 X |

FOREIGN PATENT DOCUMENTS 0 330 558 2/1989 France .

*Primary Examiner*—Frank Tsay

*Attorney, Agent, or Firm*—Antonelli, Terry, Stout & Kraus, LLP

[57] ABSTRACT

As assembly and apparatus for analyzing a physical behavior of a drill string. The assembly includes at least two measuring sensors arranged at each end of a portion of a length of the drill string. A processing installation is provided and is adapted to receive, process, record and synchronize at least one signal coming from the sensor.

27 Claims, 1 Drawing Sheet

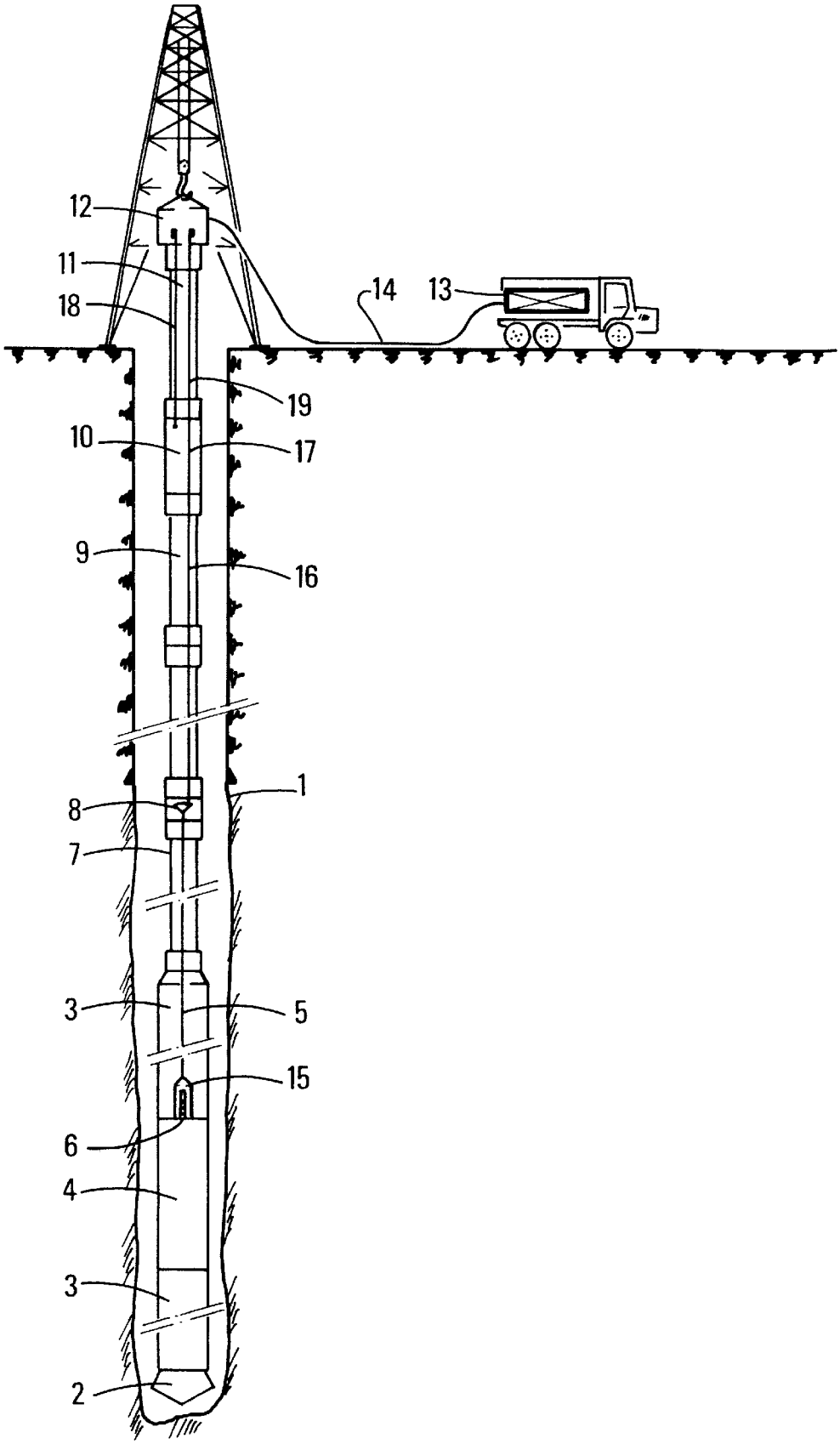
12
11
18
14
13
19
10
17
9
16
1
8
7
3
5
15
6
4
3
2

SYSTEM AND METHOD FOR THE ACQUISITION OF PHYSICAL DATA LINKED TO A DRILLING OPERATION IN PROGRESS

This application is a continuation of application Ser. No. 08/022,895, filed Feb. 26, 1993.

FIELD OF THE INVENTION

The present invention relates to an assembly and to a method allowing acquisition of information and/or of physical data linked to a drilling operation. This information may comprise essentially data linked to the mechanical behavior of the drill string during drilling, but also data on the drilling environment. To that effect, the invention utilizes at least two measuring sources. The latter are arranged preferably at a distance of several hundred meters from one another. One, near the bottom, is close to the tool, and the other is close to the surface. According to the present invention, the various measurements may be indexed in time through a synchronization system. Synchronization provides the precision essential for comparisons and correlations between the various measurements.

One object of the invention is to better understand the drilling process, notably through an analysis of the dynamic behavior of the drill string.

The action of the rock-destroying bit affects the entire equipment and of the means implementing this bit and vice versa. The drill string, consisting notably of the drill collars and the drillpipes, is the equipment which is directly linked to the bit, and the study of its mechanical behavior in dynamics is therefore particularly significant. Of course, knowledge of the other drilling parameters is also necessary to complete analyses and interpretations.

Acquisition of these data may lead to studies allowing the drilling techniques and means to be optimized. The final objective is notably to obtain a higher economic efficiency of the discovery and the development of oil pools, by means of performance and cost improvements.

BACKGROUND OF THE INVENTION

There are well-known measurement acquisition and transmission systems utilizing sensors associated with bottomhole electronics, such as those transmitting their information by pressure wave in the mud, or by electromagnetic wave. But the number of parameters transmitted is small and the transmission rate is relatively low.

In, for example, FR-2,645,205 and U.S. Pat. No. 4,715,451 a well-known measuring systems are located at the top of the drill string, near the surface. But the object of these techniques is not to use bottomhole sensors.

Furthermore, none of these documents suggests the use or the possibility of synchronizing two measuring sources arranged substantially at each end of the drill string.

On the contrary, the object of a preferred embodiment according to the present invention is to provide a system for the real time transmission of a large number of data, coming notably from sensors close to the drill bit and from surface sensors, and at the same time the possibility of recording them synchronously by a surface processing installation. In fact, it has been found, in accordance with the present invention, that comprehension and, consequently, modeling of the drilling process can only be achieved if a certain number of parameters are measured at several points of the drill string. Since drilling is a highly dynamic process, a number of these parameters have to be measured at a high rate and with a sufficient synchronization precision.

SUMMARY OF THE INVENTION

To that effect, the present invention relates to an assembly notably adapted to study the physical behaviour of a drill string.

According to the present invention, an assembly is provided which includes a first and a second measuring means each comprising each at least one sensor, with the measuring means being located substantially at the ends of a portion of length of the drill string. A linking means is provided between each of the sensors and an installation for processing the signals supplied by the sensors and conveyed through the linking means. The processing installation comprises at least one means for synchronizing the signals.

linking means between each of said sensors and an installation for processing the signals supplied by said sensors and conveyed through said linking means. Said processing installation comprises at least one means for synchronizing said signals.

The first measuring means may be located close to the drill bit and the second means may be near the surface. The processing installation may be located at the surface and is adapted to receive and record in synchronization the signals coming from the sensors.

The linking means between the sensor of the first measuring means and the processing installation may comprise an electric cable comprising at least one conductor, located in an inner space of the tubular string, an electric connector which may be plugged into a liquid environment, adapted to connect the first means to the cable, and a socket for suspending the cable and for electrically linking the cable to the processing installation.

At least one of the linking means may comprise at least one cabled pipe.

The second measuring means may be located below the kelly or the device for bringing the bit into rotation, and the linking means between the sensor of the first measuring means and the processing installation may transit through the second measuring means.

The second measuring means may be connected electrically to the processing installation and its linking means may comprise a rotating electric coupling.

In accordance with the method of the present invention, before resuming the drilling operation, an electric cable is lowered into the inner space of the drill string connecting the cable onto the first measuring means and suspending the cable by a suspension connecting socket. Following progress of the drill bit is accomplished by adding cabled pipes, with the pipes being adapted to electrically connect the first means to the surface installation, through the electric cooperation of the cable and the suspension socket. Recording and processing, in real time, results from at least one signal coming from each measuring means. The surface installation may receive, for example, from the first means, at least one of a weight of the drill bit, torque at the drill bit, acceleration in at least one direction, beginning moment in at least one plane, magnetic filed in at least one direction, pressure and temperature inside and outside the drill string, and angular acceleration, and from the second means, at least one of a measurement of internal pressure, torque, acceleration in at least one direction, tension and angular aceleration.

The first measuring means may comprise at least one sensor adapted for a measurement from of at least one of the weight on the drill bit, torque at the bit, angular acceleration, acceleration in at least one direction, bending moment in at least one plane, magnetic field in at least one direction, pressure and temperature inside and outside the string. The second measuring means may comprise at least one sensor adapted for a measurement of at least one of internal pressure, torque, acceleration in at least one direction, tension, angular acceleration.

The processing installation may synchronize the signals coming from the two measuring means by supplying the acquisition order to the second measuring means when it receives a determined signal from the first measuring means.

The processing installation may be connected to at least one sensor located on the drill rig, notably a sensor for measuring the rotation of the string or a sensor for measuring the displacement of the pipe hook.

The invention further relates to a method for acquisition of data representative of the physical conditions for a drilling operation, with the method comprising assembling a drill bit, drill collars and a first measuring means comprising at least one sensor; lowering the previous assembly into the well by adding drill pipes; assembling, in a drill string, a second measuring means comprising at least one sensor; connecting the means to a surface installation through a transmission means; rotating the drill bit; and processing and recording by way of the surface installation, at least one signal coming from each measuring means during rotation of the bit, while synchronizing the signals.

The surface installation may be connected to at least one other sensor located on the drill rig at the surface, and its signal may be synchronized with the other signals.

The method and/or the assembly in accordance with the invention may be applied to the analysis of the dynamic behavior of a drill string during a rotary drilling operation and to the optimization of the drilling parameters.

BRIEF DESCRIPTION OF THE DRAWING

Other features and advantages of the invention will be clear from reading the description hereafter given by way of non limitative examples, with reference to the accompanying drawing which schematically illustrates an acquisition system constructed in accordance with the present invention.

DESCRIPTION OF THE PREFERRED EMBODIMENTS

Referring to the single FIGURE of the drawing, a drill bit 2 lowered by a string into well 1. Conventional drill collars 3 are threadably attached above the tool. The first measuring means includes a measuring sub 4, generally located above the bit 2, where measurements close to the bit are more significant, notably to follow the dynamics of the bit. However, it may also be located inside or at the top of the drill collars, or even at the level of the drillpipes.

The drill string is completed with conventional pipes 7 up to the suspension and connecting socket 8. Lengthening of the drill string is continued above this socket by adding cabled pipes 9.

Cabled pipes 9, of a conventional construction, are described in, for example, FR-2,530,876, U.S. Pat. No. 4,806,115 or patent application FR-2,656,747.

The second measuring means, located in a sub 10, is threadably attached below a kelly 11. Additions of cabled pipes are then achieved below this sub 10. A rotating electric coupling 12, which is electrically connected to the surface installation 13 by a cable 14, is located above kelly 11.

In case the drill rig is provided with a power swivel, there is no kelly and measuring sub 10 is threaded directly below rotating coupling 12, which is located below the power swivel.

Measuring sub 4 comprises a pin connector 6 whose contacts are connected to the measuring sensors and to the associated electronics included in sub 4.

A cable 5, equivalent to a wireline logging cable, comprises at its lower end a socket connector 15 adapted to co-operate with connector 6. The other upper end of cable 5 is suspended on socket 8. Socket 8 is adapted to suspend the length of cable 5 and to connect electrically the conductor or conductors of cable 5 to the electric link or links of the next higher cabled pipe. The electric link provided by the cabled pipes is referenced 16. This electric link transits through 17 into the second measuring sub 10.

When a kelly 11 is used, the latter is also cabled and comprises two electric cables 18 and 19. One cable 18, connects the second sub 10 to the rotating contacts of rotating coupling 12, and the other cable 19, connects line 17 to other rotating contacts of coupling 12.

The rotating electric coupling twelve may comprise 12 tracks. The coupling 12 is designed so as to respect the anti-explosion standards required in the environment of a drill floor.

The surface cable 14 may comprise at least six conductors.

Sub 4 is generally connected through a single conductor to the surface installation 13. Measurements and power supply also transit through this line.

The measuring means of the sub 4 preferably includes sensors to measure one or more of the weight on the drill bit, the reactive torque at the drill bit, the bending moments in two orthogonal planes, the accelerations along three orthogonal planes among which one merges with the longitudinal axis of the drill string, the temperature and pressure inside and outside the drill string, the angular acceleration, and the components of the magnetic field.

The first three measurements may be obtained through strain gages disposed on a test cylinder. They are protected against the pressure by an appropriate housing. The design and the mounting of this housing are adapted to avoid measuring errors due to outputs.

Accelerations are measured by two accelerometers per axis in order to control errors induced by the rotation dynamics.

The last measurement set is obtained by specific sensors mounted in a separate part of the sub.

The orders of magnitude of the mechanical characteristics of the first sub 4 are, for example, an outside diameter of 20.3 cm (8 to 8.25 inches), a length of 9 m, a tensile/compressive strength of 150 tf, a torsional strength of 4,000 m.daN, a bending strength of 7,500 m.daN, an internal and external pressure of 75 MPa, and a temperature of 80° C.

The second measuring means of the measuring sub 10 preferably comprises one or more sensors for measuring, a tension, a torsion, an axial acceleration, an internal pressure or pump discharge pressure, and an angular acceleration.

The design of this surface sub 10 is not basically different from that of the first sub, except for the obligation to provide a free mud passage arranged substantially coaxial to the inner space of the string so as to allow a bit to be transferred inside the string if need be.

The orders of magnitude of the mechanical characteristics of the second sub 10 may, for example, have an outside diameter of 20.3 cm (8 to 8.25 inches), a length of 1.5 m (5 feet), a tensile strength of 350 tf, a torsional strength of 7,000 m.danN, and an internal/external pressure of 75/50 MPa.

In a variant of the acquisition system in accordance with the invention, a high measurement transmission frequency is obtained with electric links including a cable 5, line 16 and 17, and surface cable 14. Some bottomhole sensors, which do not require high frequency sampling, may transmit their measurements through other means, for example, by pressure wave or by electromagnetic wave.

In a simplified variant of this system, only the surface sensors included in the second sub and possibly the other sensors of the drill rig will be connected electrically to the surface installation. The sensors of the first sub are then connected to the surface by another transmission means, for example those cited above. Of course, the surface installation remains adapted to synchronize at least one bottomhole measurement with certain surface measurements.

Without departing from the scope of this invention, the link between the second sub and the surface installation may be other than electric, for example a radio or an optical link.

The data acquisition units comprise sensors, amplifiers and filters. If necessary, preamplifiers will be preferably placed as close as possible to the sensors so as to avoid background noise. Analog memories, in the form of five samplers/stoppers, allow notably acquisition of five channels at the same time and under the same address.

This design example allows a very precise synchronism between five parameters. Between the two subs or the other surface sensors, the synchronization principle consists in recording signals synchronously in the analog memories at the same time. Synchronization is pilot-controlled by the surface installation; when it receives a group of five measurements and its address from the first sub, it sends the acquisition order for its own measurements to the second sub. The synchronization precision of course depends on the length of the linking lines and on the processing rate in the installation, but this precision remains excellent and, in all cases, is of the order of one millisecond, but preferably less than this value.

When other surface sensors are connected to the surface installation 13, for example a rotation sensor located on rotating coupling 12, a sensor for picking up the displacement of the pipe hook, or certain sensors in the geologic monitoring cab, the synchronization of the measurements supplied by these sensors is advantageouly possible. The second sub triggers the acquisition order for these other sensors, of course, by the surface installation.

The two or three streams of data coming from the two subs and from the surface sensors are recorded together and stored by surface installation 13.

The surface installation mainly comprises a computer, a monitor screen, data storage means, recorders and a power supply unit. The two subs may be fed by the electric conductors under 130 VAC at 50 or 400 Hz.

All the data are binary coded and multiplexed before being sent through the transmission channel.

The electric transmission makes it possible to reach 30 kbits per second over a line length of about 3,000 meters. The transmission frequency of the groups including five measurements and the address may be 400 Hz, with a 10-bit resolution. This arrangement allows four signals to be transmitted at the maximum frequency, and the others at lower frequencies.

With a 12-bit resolution, the maximum frequency will be 360 Hz.

Measurements are to be taken during the entire or part of a drilling phase performed by a new bit. The previous bit has reached a given depth. The bit 2, the first sub 4 provided with pin connector 6 and the drill collars 3 are assembled by the drill rig. This assembly is lowered to the well bottom, by assembling conventional drillpipes. When the bit is close to the bottom, suspension socket 8 is threaded on the upper end of the present string.

By an auxiliary winch, cable 5, provided at its lower end with socket connector 15 and the indispensable ballast weight, is lowered inside the string. Cable 5 is connected to measuring sub 4 and suspended on socket 8. The link between the electric conductor of the cable and the means integral with socket 8, adapted to make contact with the first cabled pipe which will be added, is achieved manually or automatically. At the end of this procedure, the string comprising the first sub is thus suspended on the rotary table and comprises also an electric link with measuring sub 4.

At the same time, rotating coupling 12 is installed on the cabled kelly 11 or below the power swivel. The surface installation 13 is connected to the rotating coupling by cable 14. The second sub 10 is threadably secured either below the kelly, or directly below the rotating coupling when a power swivel is used.

The rotary drilling or downhole motor drilling operation, and jointly measurement acquisition, may be started in dependence upon either drilling of the kelly, with the lines 17 being connected to the sub 4 by the connection of the second sub 10 with the suspension socket 8, or by adding a cabled pipe 9 when the equipment comprises a power swivel or when drilling is achieved with a downhole motor.

The operation is continued by adding cabled pipes as long as an electric link is desired with the first measuring sub 4.

This invention is not limited to the lay-out described above, although it is a preferred lay-out, in which the two measuring subs are placed one close to the bit, and the other near the surface. In fact, the object of the device and of the method in accordance with the invention is also to analyze the dynamic behavior of a portion of the string. To that effect, the two measurings subs will be placed at each end of the string portion to be studied. What is understood to be a string portion is at least one length of a tubular element, a pipe or a drill collar of about 9 meters. In the case where the second sub is distant from the surface, its connection to the surface may be preferably achieved with the cabled pipes. Thus, the cabled pipes contained between the surface and the second sub will constitute a transmission channel common to the two subs. Of course, the measuring subs will be adapted for this transmission mode.

Although the present invention is particularly adapted to rotary drilling conditions, that is to say that the string is brought into rotation by a surface motorization, drilling with a downhole motor is in no way excluded from the application of this measuring assembly.

What is claimed is:

1. An assembly for acquiring information relating to a drill string while drilling in a well bore during a drilling operation, the assembly comprising:

a first and a second measuring means each comprising at least one sensor with each sensor producing measurement signals representing sensed information, one of said measuring means being located on the drill string substantially at a surface of the well bore and the other measuring means being located on the drill string in a vicinity of a tool disposed at a lower end of the drill string;

linking means including an electrical cable, said linking means being disposed between each of said sensors and a processing installation for processing the measurement signals supplied by said sensors and conveyed by said electrical cable of said linking means to the processing installation; and wherein said processing installation comprises means for processing of said measurement signals so that acquiring of said measurement signals from said first and second measuring means is synchronized in time.

2. An assembly as claimed in claim 1, wherein the processing installation is disposed at the surface of the well bore and synchronously in time records the measurement signals supplied by the at least one sensor of the first and second measuring means.

3. An assembly in accordance with claim 2 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

4. An assembly as claimed in claim 1, wherein said linking means between the sensor of the first measuring means and the processing installation comprises:

an electric connector to be plugged-in in a liquid environment and to connect the first measuring means to said electrical cable; and a socket for suspending said electrical cable and for electrically linking said electrical cable to said processing installation; and wherein the electrical cable includes at least one conductor located in an inner space of the drill string.

5. An assembly in accordance with claim 4 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

6. An assembly as claimed in claim 1, wherein at least one of said linking means comprises at least one cabled pipe.

7. An assembly in accordance with claim 6 wherein:

the means for processing issues a communication transmitted by the electrical cable to the other measuring means in response to the receipt of the measurement signals from the at least one sensor of the one measuring means, which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

8. An assembly as claimed in claim 1, wherein:

the second measuring means is located below a kelly or a device for bringing the tool into rotation, and wherein the linking means between the sensor of the first measuring means and the processing installation extends through the second measuring means.

9. An assembly in accordance with claim 8 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

10. An assembly as claimed in claim 1, wherein the second measuring means is electrically connected to the processing installation, and wherein the linking means comprises a rotating electric coupling.

11. An assembly in accordance with claim 10 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

12. An assembly as claimed in claim 1, wherein the first measuring means comprises at least one sensor adapted for measuring at least one of a weight of the tool, torque at the tool, angular acceleration, acceleration in at least one direction, bending moment in at least one plane, magnetic field in at least one direction, pressure and temperature inside and outside the drill string, and wherein the second measuring means comprises at least one sensor adapted for measuring at least one of internal pressure, torque, acceleration in at least one direction, tension, and angular acceleration.

13. An assembly in accordance with claim 12 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

14. An assembly as claimed in claim 1, wherein the processing installation synchronizes the signals supplied from said first and second measuring means by supplying an acquisition order to the second measuring means when said processing installation receives a predetermined signal from the first measuring means.

15. An assembly in accordance with claim 14 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

16. An assembly as claimed in claim 1, wherein:

the processing installation is connected to at least one sensor located on a drill rig for measuring a rotation of the drill string or the displacement of a pipe hook in the drill string.

17. An assembly in accordance with claim 16 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

18. An assembly in accordance with claim 1 wherein:

the means for processing issues a communication transmitted by the electrical cable to the other measuring means in response to the receipt of the measurement signals from the at least one sensor of the one measuring means which causes the other measuring means to transmit the measurement signals from the at least one sensor thereof to the processing installation; and further comprising a memory, coupled to the processing installation, for synchronously storing the measurement signals from the first and second processing means as acquired by the processing installation synchronously in time.

19. A method for acquisition of data representative of a drilling operation, the method comprising the steps:

making an assembly of a drill bit, drill collars and a first measuring means comprising at least one sensor with each sensor producing measurement signals representing sensed information;

lowering the assembly into a well by adding drill pipes;

assembling, in a drill string, a second measuring means comprising at least one sensor with each sensor producing measurement signals representing sensed information;

connecting said first measuring means and said second measuring means to a surface installation with a signal transmission means;

rotating the drill bit; and processing and recording, by the surface installation, at least one measurement signal supplied from each of the first and second measuring means during the rotation of the drill bit, while synchronizing in time acquisition of at the least one measurement signal supplied from the first measuring means and the at least one measurement signal supplied from the second measuring means.

20. A method as claimed in claim 19, wherein:

the second measuring means is located close to a surface of a well bore.

21. A method as claimed in one of claims 10 or 11, wherein the surface installation receives:

from the first measuring means, measurement signals representing at least one of weight on the drill bit, torque on the drill bit, acceleration of the drill bit in at least one direction in a coordinate system, bending moment of the drill string in at least one plane, a magnitude of a magnetic field in at least one direction in a coordinate system, pressure and temperature inside of and outside the drill string, and angular acceleration of the drill string; and from the second measuring means, measurement signals representing at least one of internal pressure, torque, acceleration in at least one direction, tension, and angular acceleration of the drill string.

22. A method in accordance with claim 21 wherein:

the processing by the surface installation includes issuing a communication transmitted with the transmission means to the first measuring means in response to the receipt of the measurement signals from the at least one sensor of the second measurement means which causes the first measurement means to transmit the measurement signals from the at least one sensor thereof to the processing installation; and further comprising storing the synchronously acquired measurement signals synchronously in a memory.

23. A method as claimed in one of claims 19 or 20, wherein:

the surface installation is connected to at least one other sensor located at the surface and wherein a signal from said at least one other sensor is synchronized in time with the signals received from the sensors of said first and second measuring means.

24. A method in accordance with claim 23 wherein:

the processing by the surface installation includes issuing a communication transmitted with the transmission means to the first measuring means in response to the receipt of the measurement signals from the at least one sensor of the second measurement means which causes the first measurement means to transmit the measurement signals from the at least one sensor thereof to the processing installation; and further comprising storing the synchronously acquired measurement signals synchronously in a memory.

25. A method in accordance with claim 19 wherein:

the processing by the surface installation includes issuing a communication transmitted with the transmission means to the first measuring means in response to the receipt of the measurement signals from the at least one sensor of the second measurement means which causes the first measurement means to transmit the measurement signals from the at least one sensor thereof to the processing installation; and further comprising storing the synchronously acquired measurement signals synchronously in a memory.

26. A method in accordance with claim 20 wherein:

the processing by the surface installation includes issuing a communication transmitted with the transmission means to the first measuring means in response to the receipt of the measurement signals from the at least one sensor of the second measurement means which causes the first measurement means to transmit the measurement signals from the at least one sensor thereof to the processing installation; and further comprising storing the synchronously acquired measurement signals synchronously in a memory.

27. An assembly for acquiring information relating to a drill string while drilling in a well bore during a drilling operation, the assembly comprising:

first and second measuring means each comprising at least one sensor with each sensor producing measurement signals representing sensed information, one of said measuring means being located on a drill string substantially at a surface of the well bore and the other measuring means being located on a drill string in a vicinity of a tool disposed at a lower end of the drill string;

linking means including an electrical cable, said linking means being disposed between each of said sensors and a processing installation for processing the measurement signals supplied by said sensors and conveyed by said electrical cable of said linking means to the processing installation; and wherein said processing installation comprises means for processing of said measurement signals so that acquiring of said measurement signals from said first and second measuring means is synchronized in time; and wherein the processing installation synchronizes in time the measurement signals acquired from said sensors of said first and second measuring means by supplying an acquisition order to the second measuring means when said processing installation receives a predetermined signal from the first measuring means; and a memory for storing synchronously the acquired measurement signals from said sensors of said first and second measuring means.

* * * * *